US009692163B1

(12) United States Patent
Didonato et al.

(10) Patent No.: US 9,692,163 B1
(45) Date of Patent: Jun. 27, 2017

(54) CRUSH RIB HOUSING FOR POSTIVE LOCK RECEPTACLE

(71) Applicant: TE CONNECTIVITY CORPORATION, Berwyn, PA (US)

(72) Inventors: Michael Edward Didonato, Harrisburg, PA (US); David T. Humphrey, Red Lion, PA (US); Raymond L. Landon, III, Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/251,592

(22) Filed: Aug. 30, 2016

(51) Int. Cl.
*H01R 13/115* (2006.01)
*H01R 4/70* (2006.01)
*H01R 4/18* (2006.01)
*H01R 4/48* (2006.01)

(52) U.S. Cl.
CPC ..... *H01R 13/115* (2013.01); *H01R 4/185* (2013.01); *H01R 4/48* (2013.01); *H01R 4/70* (2013.01)

(58) Field of Classification Search
CPC ..... H01R 4/01; H01R 13/115
See application file for complete search history.

(56) References Cited

U.S. PATENT DOCUMENTS 3,514,740 A * 5/1970 Filson ..... H01R 13/115 403/285
3,555,493 A * 1/1971 Baumanis ..... H01R 12/721 439/636
3,771,111 A * 11/1973 Pritulsky ..... H01R 43/058 439/850
4,348,070 A * 9/1982 Simon ..... H01R 13/501 439/586
4,395,081 A * 7/1983 Melys ..... H01R 4/64 439/387
4,421,375 A * 12/1983 Coldren ..... H01R 4/2462 439/423
4,534,613 A * 8/1985 Esser ..... H01R 13/20 439/834
4,598,474 A * 7/1986 Lutz ..... H01R 13/115 29/863
5,411,419 A * 5/1995 Ochi ..... H01R 13/115 439/787
7,198,526 B1 * 4/2007 MacNeil ..... H01R 4/185 439/881

(Continued)

OTHER PUBLICATIONS

Drawing No. C-521997, Assembly, Ultra-Pod, Receptacle, 6.35 [.250] Series, Rev. C, Jan. 8, 2013, 1 page, TE Connectivity.

*Primary Examiner* — James Harvey

(57) ABSTRACT

A receptacle connector that includes a positive lock receptacle, wherein the positive lock receptacle includes a wire receiving portion; and a housing insertion portion, wherein the housing insertion portion further includes a first electrical contact roll and a second electrical contact roll; and a housing adapted to receive the positive lock receptacle, wherein the housing includes: an insulating housing body; and a first crush rib positioned within the insulating housing body and a second crush rib positioned within the insulating housing body, wherein the first and second crush ribs engage and secure the first and second electrical contact rolls respectively upon insertion of the housing insertion portion of the positive lock receptacle into the housing.

17 Claims, 4 Drawing Sheets

(56) References Cited

U.S. PATENT DOCUMENTS

| | | | | |
|---|---|---|---|---|
| 8,057,261 | B1 * | 11/2011 | DeSio | H01R 13/506<br>439/625 |
| 2005/0000721 | A1 * | 1/2005 | Muller | H01R 4/024<br>174/84 C |
| 2010/0221930 | A1 * | 9/2010 | Hying | H01R 13/115<br>439/77 |

* cited by examiner

CRUSH RIB HOUSING FOR POSTIVE LOCK RECEPTACLE

BACKGROUND OF THE INVENTION

The described invention relates in general to electrical connectors, and more specifically to an insulated housing that includes multiple crush ribs for securely retaining a positive lock receptacle that has been inserted into the insulated housing.

Receptacle connectors are commonly used devices in various electronics applications. Such devices typically include two primary components: (i) a terminal or receptacle for receiving and terminating a wire; and (ii) a housing for receiving the receptacle. When properly assembled, a de-insulated wire is inserted into the receptacle, and the receptacle is inserted into the housing. A protective cap may be placed over the housing to enclose the wire and receptacle. The assembly is then connected (i.e., mated) to another wire or electrical device, as may be appropriate.

Certain receptacles are designed as "positive lock" receptacles and include unique characteristics such as reduced mating forces and a large locking dimple on flexible latch. This locking feature acknowledges proper mating with an audible "snap" of the locking dimple into a corresponding mating aperture. This design enhances safety and reliability of the mated pair for isolated and hard to reach areas. Until the release latch is depressed manually the receptacle cannot be removed from the housing. Thus, the potential of exposed live parts or disruption of critical circuitry due to improperly seated or accidentally removed terminals is greatly reduced. However, in certain situations, the assembled connector may be under considerable force or tension that can result in the receptacle being pulled loose from the housing, even in the presence of a positive lock configuration. Accordingly, there is an ongoing need for a housing that includes certain additional structural features for effectively retaining the receptacle within the housing following assembly of the receptacle connector.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a first receptacle connector is provided. This receptacle connector includes a positive lock receptacle, wherein the positive lock receptacle includes a wire receiving portion; and a housing insertion portion, wherein the housing insertion portion further includes a first electrical contact roll and a second electrical contact roll; and a housing adapted to receive the positive lock receptacle, wherein the housing includes an insulating housing body; and a first crush rib positioned within the insulating housing body and a second crush rib positioned within the insulating housing body, wherein the first and second crush ribs engage and secure the first and second electrical contact rolls respectively upon insertion of the housing insertion portion of the positive lock receptacle into the housing.

In accordance with another aspect of the present invention, a second receptacle connector is provided. This receptacle connector includes a positive lock receptacle, wherein the positive lock receptacle includes a wire receiving portion; and a housing insertion portion, wherein the housing insertion portion further includes a first electrical contact roll and a second electrical contact roll; a housing adapted to receive the positive lock receptacle, wherein the housing includes: an insulating housing body, wherein the insulating body further includes a plurality of retaining tabs formed thereon; and a first crush rib positioned within the insulating housing body and a second crush rib positioned within the insulating housing body, wherein the first and second crush ribs engage and secure the first and second electrical contact rolls respectively upon insertion of the housing insertion portion of the positive lock receptacle into the housing; and a cap, wherein the cap includes a plurality of retaining arms formed thereon that cooperate with the retaining tabs formed on the insulating housing body for connecting the cap to the housing and enclosing the positive lock receptacle therein.

In yet another aspect of this invention, a connector housing is provided. This connector housing includes an insulating housing body, wherein the insulating housing body is adapted to receive a positive lock receptacle that includes first and second electrical contact rolls; and first and second crush ribs positioned within the insulating housing body, wherein the first and second crush ribs are adapted to engage and secure the first and second electrical contact rolls respectively upon insertion of the positive lock receptacle into the housing.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
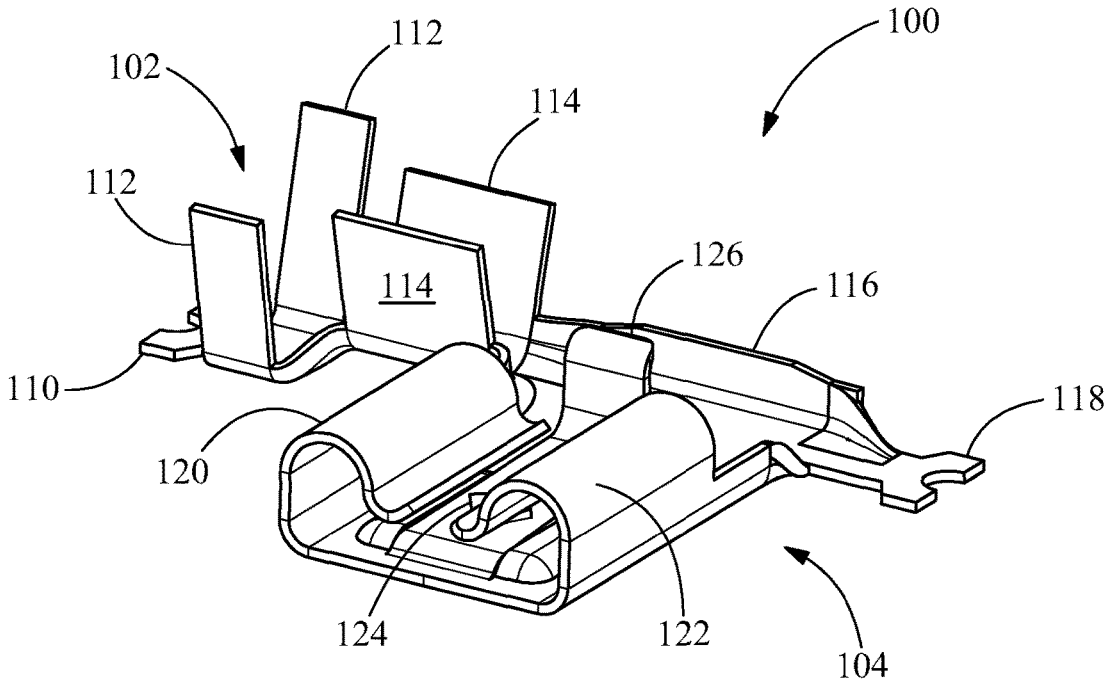
FIG. 1 is a front, perspective view of a positive lock receptacle in accordance with an exemplary embodiment of the present invention.

Exemplary embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

Figure 2:
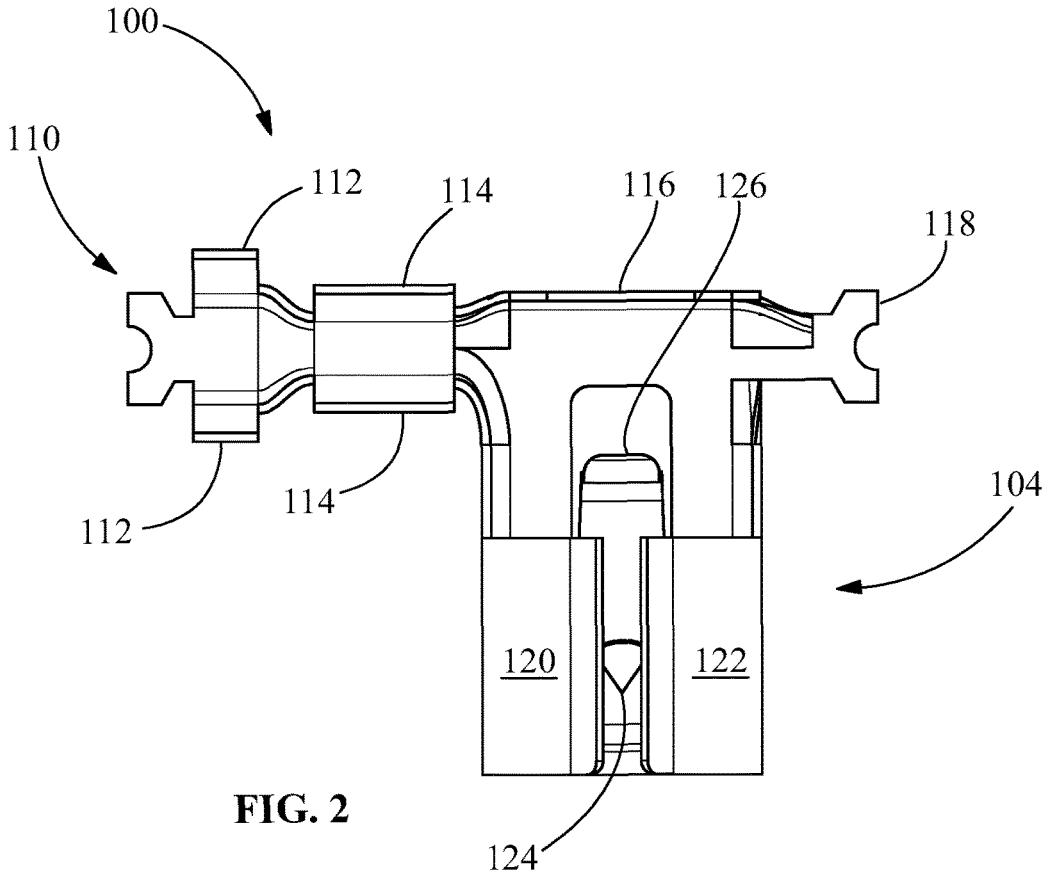
FIG. 2 is a top view of the positive lock receptacle of FIG. 1.
Figure 3:
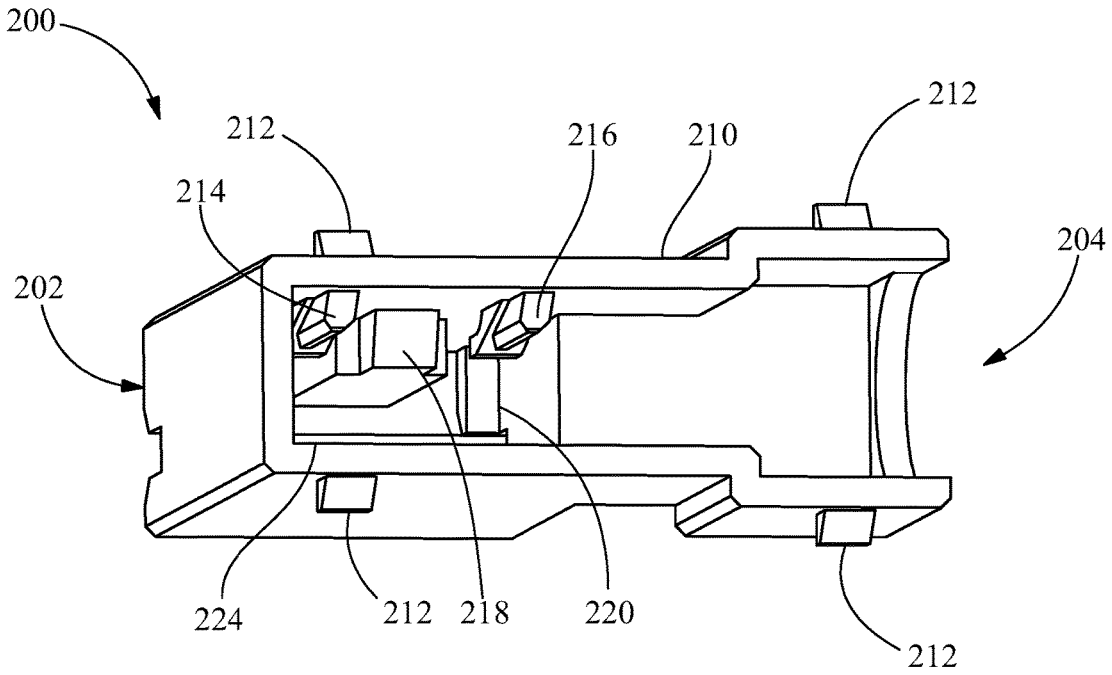
FIG. 3 is a rear perspective view of a receptacle housing in accordance with an exemplary embodiment of the present invention.
Figure 4:
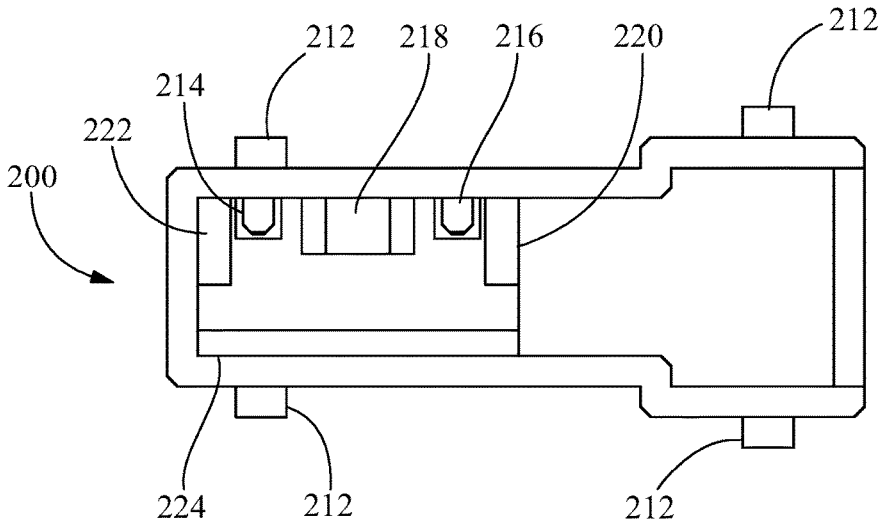
FIG. 4 is a rear view of the receptacle housing of FIG. 3.
Figure 5:
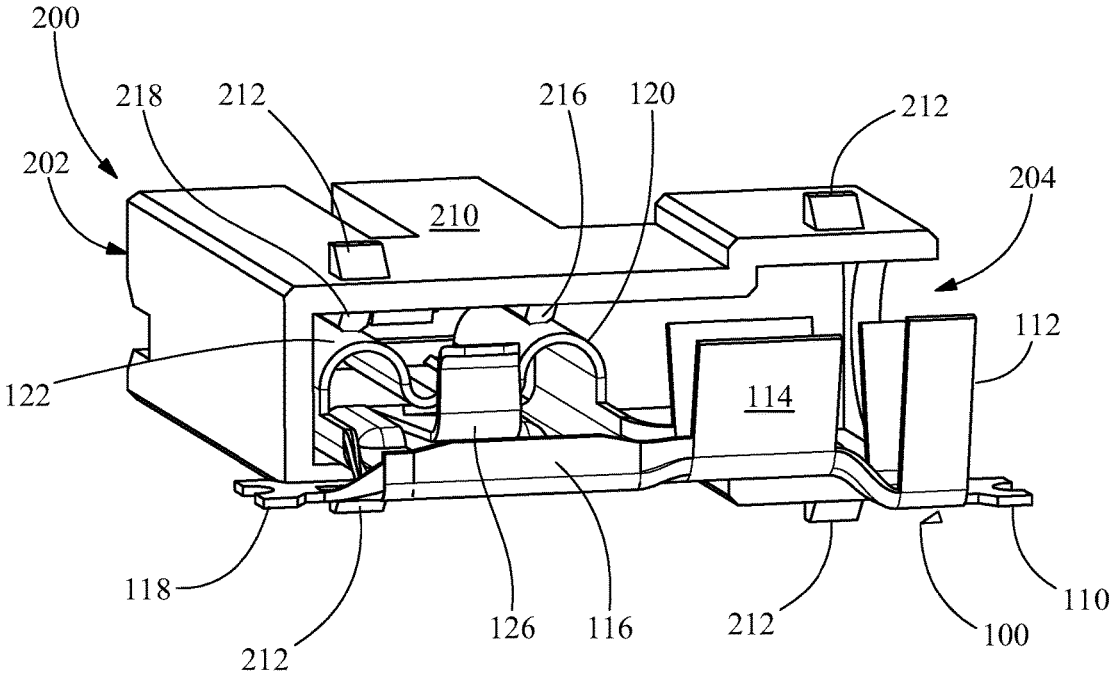
FIG. 5 is a rear perspective view of the positive lock receptacle of FIG. 1 properly inserted into and engaging the receptacle housing of FIG. 3 to form a connector.
Figure 6:
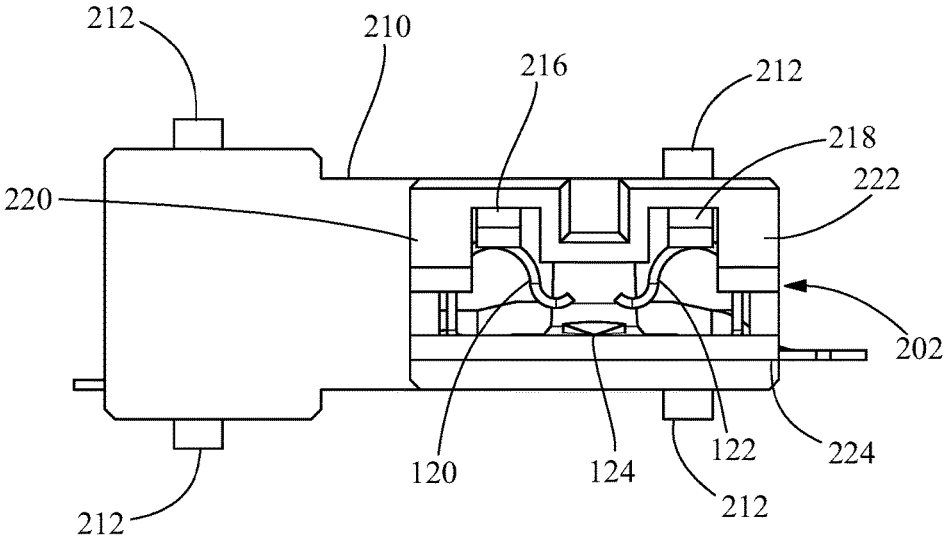
FIG. 6 is a front view of the connector of FIG. 5.

As previously stated, the present invention provides an insulated connector housing that includes multiple crush ribs for securely retaining a positive lock receptacle that has been inserted into the connector housing. With reference to the Figures, FIGS. 1 and 2 provide illustrations of an exemplary positive lock terminal or receptacle for use with the connector housing of this invention. As shown in FIGS. 1-2, exemplary positive lock terminal/receptacle 100 includes insulation barrel 102 and housing insertion portion 104. Insulation barrel 102 further includes first carrier strip 110, insulation crimp 112, wire barrel crimp 114, ergonomic retention wall 116, and second carrier 118. Housing insertion portion 104 includes first electrical contact roll 120, second electrical contact roll 122, locking dimple 124, and release latch 126.

Figure 7:
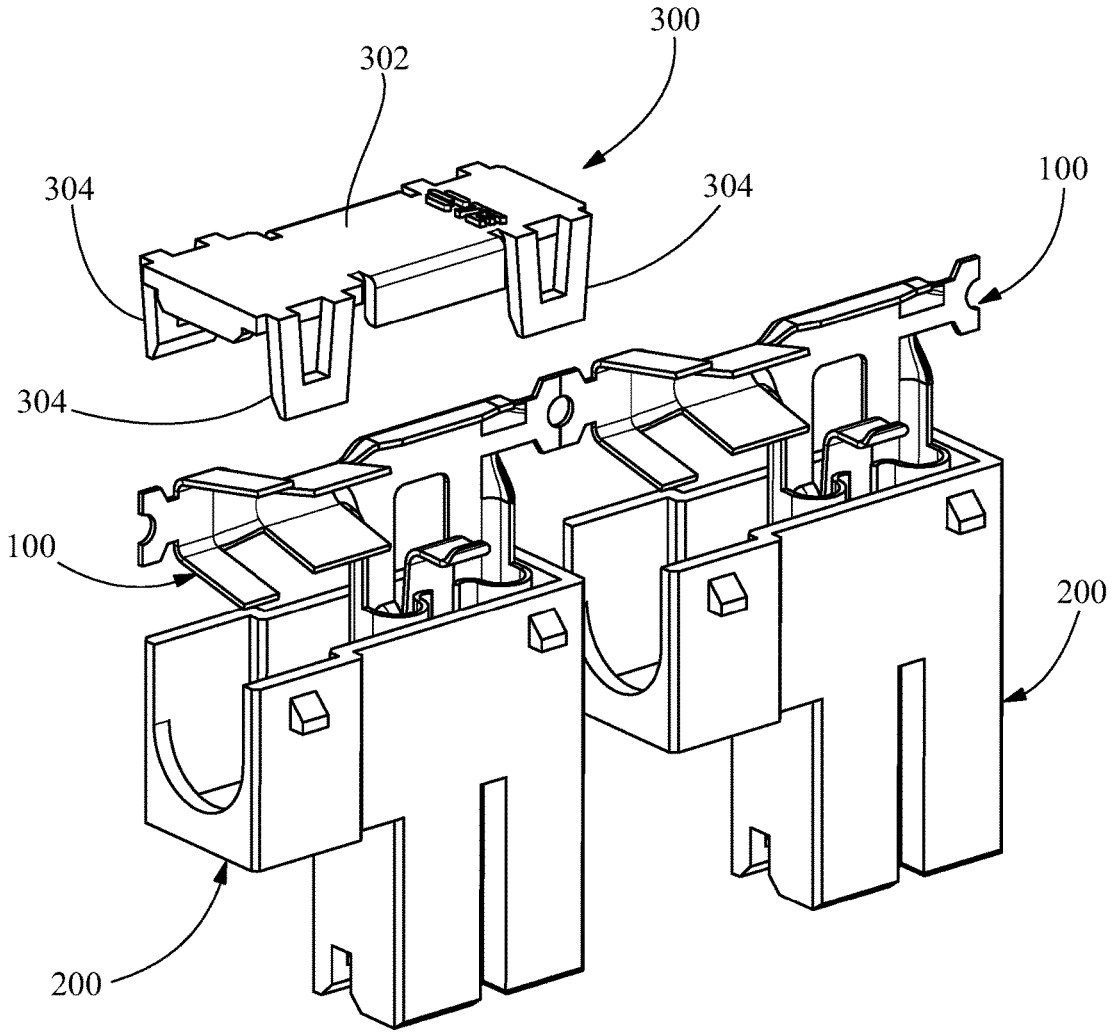
FIG. 7 is a top, perspective view of multiple positive lock receptacles being inserted into multiple receptacle housings, wherein a protective cap is also provided.

FIGS. 3-6 provide illustrations of a crush rib connector housing 200 in accordance with an exemplary embodiment of the present invention, wherein crush rib connector housing 200 is adapted to receive positive lock receptacle 100 and securely retain positive lock receptacle 100 therein. As shown in FIGS. 3-6, connector housing 200 includes mating end 202 for joining or mating with other connectors and receptacle insertion end (wire exit) 204 for receiving housing insertion portion 104 of positive lock receptacle 100. Connector housing 200 further includes insulating body 210 (the material of which provides electrically insulating properties to connector housing 200), retaining tabs 212, first crush rib 214, second crush rib 216, positive lock CAM 218, first contact stop 220, second contact stop 222, and third contact stop 224, all of which serve to properly position housing insertion portion 104 within connector housing 200. As shown in FIG. 7, protective cap 300 includes body 302 and retaining arms 304 formed thereon that cooperate with retaining tabs 212 formed on the housing body 210 for connecting cap 300 to housing 200 and enclosing positive lock receptacle 100 therein.

When properly assembled, an electrical wire is terminated to positive lock receptacle 100, which is then inserted into connector housing as shown in FIG. 7. Upon exerting sufficient force, first and second electrical contact rolls 120 and 122 engage first and second crush ribs 214 and 216, respectively. During the insertion process, crush ribs 214 and 216 deform, thereby ensuring a tight and secure fit between electrical contact rolls 120 and 122 and connector housing 200 without creating significant stress on the contact rolls. Cap 300 is then attached to connector housing 200 to form the complete receptacle connector.

While the present invention has been illustrated by the description of exemplary embodiments thereof, and while the embodiments have been described in certain detail, there is no intention to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the general inventive concept.

What is claimed:

1. A receptacle connector, comprising:

(a) a positive lock receptacle, wherein the positive lock receptacle includes:
  (i) a wire receiving portion; and
  (ii) a housing insertion portion, wherein the housing insertion portion further includes a first electrical contact roll and a second electrical contact roll; and (b) a housing adapted to receive the positive lock receptacle, wherein the housing includes:
  (i) an insulating housing body; and
  (ii) a first crush rib positioned within the insulating housing body and a second crush rib positioned within the insulating housing body,
  (iii) wherein the first and second crush ribs engage and secure the first and second electrical contact rolls respectively upon insertion of the housing insertion portion of the positive lock receptacle into the housing.

2. The connector of claim 1, further comprising a cap, where in the cap connects to the housing and encloses the positive lock receptacle therein.

3. The connector of claim 1, wherein the wire receiving portion of the positive lock receptacle further includes a first carrier strip, an insulation crimp, a wire barrel crimp, an ergonomic retaining wall, and a second carrier strip.

4. The connector of claim 1, wherein the housing insertion portion of the positive lock receptacle further includes a locking dimple and a release latch.

5. The connector of claim 1, wherein the housing further includes a mating end for mating with other connectors and receptacle insertion end for receiving the housing insertion portion of the positive lock receptacle.

6. The connector of claim 1, wherein the housing further includes a positive lock CAM, a first contact stop, a second contact stop, and a third contact stop formed therein.

7. A receptacle connector, comprising:

(a) a positive lock receptacle, wherein the positive lock receptacle includes:
  (i) a wire receiving portion; and
  (ii) a housing insertion portion, wherein the housing insertion portion further includes a first electrical contact roll and a second electrical contact roll;

(b) a housing adapted to receive the positive lock receptacle, wherein the housing includes:
  (i) an insulating housing body, wherein the insulating body further includes a plurality of retaining tabs formed thereon; and
  (ii) a first crush rib positioned within the insulating housing body and a second crush rib positioned within the insulating housing body,
  (iii) wherein the first and second crush ribs engage and secure the first and second electrical contact rolls respectively upon insertion of the housing insertion portion of the positive lock receptacle into the housing; and (c) a cap, wherein the cap includes a plurality of retaining arms formed thereon that cooperate with the retaining tabs formed on the insulating housing body for connecting the cap to the housing and enclosing the positive lock receptacle therein.

8. The connector of claim 7, wherein the wire receiving portion of the positive lock receptacle further includes a first carrier strip, an insulation crimp, a wire barrel crimp, an ergonomic retaining wall, and a second carrier strip.

9. The connector of claim 7, wherein the housing insertion portion of the positive lock receptacle further includes a locking dimple and a release latch.

10. The connector of claim 7, wherein the housing further includes a mating end for mating with other connectors and receptacle insertion end for receiving the housing insertion portion of the positive lock receptacle.

11. The connector of claim 7, wherein the housing further includes a positive lock CAM, a first contact stop, a second contact stop, and a third contact stop formed therein.

12. A connector housing, comprising:

(a) an insulating housing body, wherein the insulating housing body is adapted to receive a positive lock receptacle that includes first and second electrical contact rolls; and (b) first and second crush ribs positioned within the insulating housing body, (c) wherein the first and second crush ribs are adapted to engage and secure the first and second electrical contact rolls respectively upon insertion of the positive lock receptacle into the housing.

13. The connector housing of claim 12, wherein the housing further includes a mating end for mating with other connectors and receptacle insertion end for receiving the housing insertion portion of the positive lock receptacle.

14. The connector housing of claim 12, wherein the housing further includes a positive lock CAM, a first contact stop, a second contact stop, and a third contact stop formed therein.

15. The connector housing of claim 12, wherein the housing further includes a plurality of retaining tabs formed thereon.

16. The connector housing of claim 15, further comprising a cap, wherein the cap further includes a plurality of retaining arms formed thereon that cooperate with the retaining tabs formed on the housing for connecting the cap to the housing and enclosing the positive lock receptacle therein.

17. The connector housing of claim 12, wherein housing includes material that provides electrically insulating properties to the housing.

* * * * *